United States Patent [19]

Debaise

[11] 4,360,133

[45] Nov. 23, 1982

[54] APPARATUS FOR POURING MOLTEN STEEL

[75] Inventor: Michel J. Debaise, Mont-sur-Marchienne, Belgium

[73] Assignee: Hainaut-Sambre S.A., Charleroi, Belgium

[21] Appl. No.: 229,855

[22] Filed: Jan. 30, 1981

[30] Foreign Application Priority Data

Jan. 31, 1980 [BE] Belgium ..... 881486

[51] Int. Cl.[3] ..... B22D 41/10

[52] U.S. Cl. ..... 222/590; 222/591; 222/601; 222/603

[58] Field of Search ..... 164/335, 337; 222/591, 222/600, 601, 603, 59, 590

[56] References Cited

U.S. PATENT DOCUMENTS

| | | | |
|---|---|---|---|
| 2,957,936 | 10/1960 | Bugge | 222/601 X |
| 3,480,186 | 11/1969 | Grosko | 222/600 |
| 3,604,603 | 9/1971 | Grosko et al. | 222/600 |
| 3,908,734 | 9/1975 | Pollard | 222/603 X |

FOREIGN PATENT DOCUMENTS

| | | | |
|---|---|---|---|
| 2064123 | 3/1972 | France | 222/591 |
| 549212 | 11/1942 | United Kingdom | 222/591 |
| 969560 | 9/1964 | United Kingdom | 222/591 |

*Primary Examiner*—David A. Scherbel
*Attorney, Agent, or Firm*—Holman & Stern

[57] ABSTRACT

A mounting chassis, fixed by locking pivots to the base plate of a tundish in a continuous casting plant, supports an upper nozzle seated in a refractory brick. A replaceable lower nozzle coaxial with the upper nozzle is held in contact with the upper nozzle by a quick-release ring.

15 Claims, 1 Drawing Figure

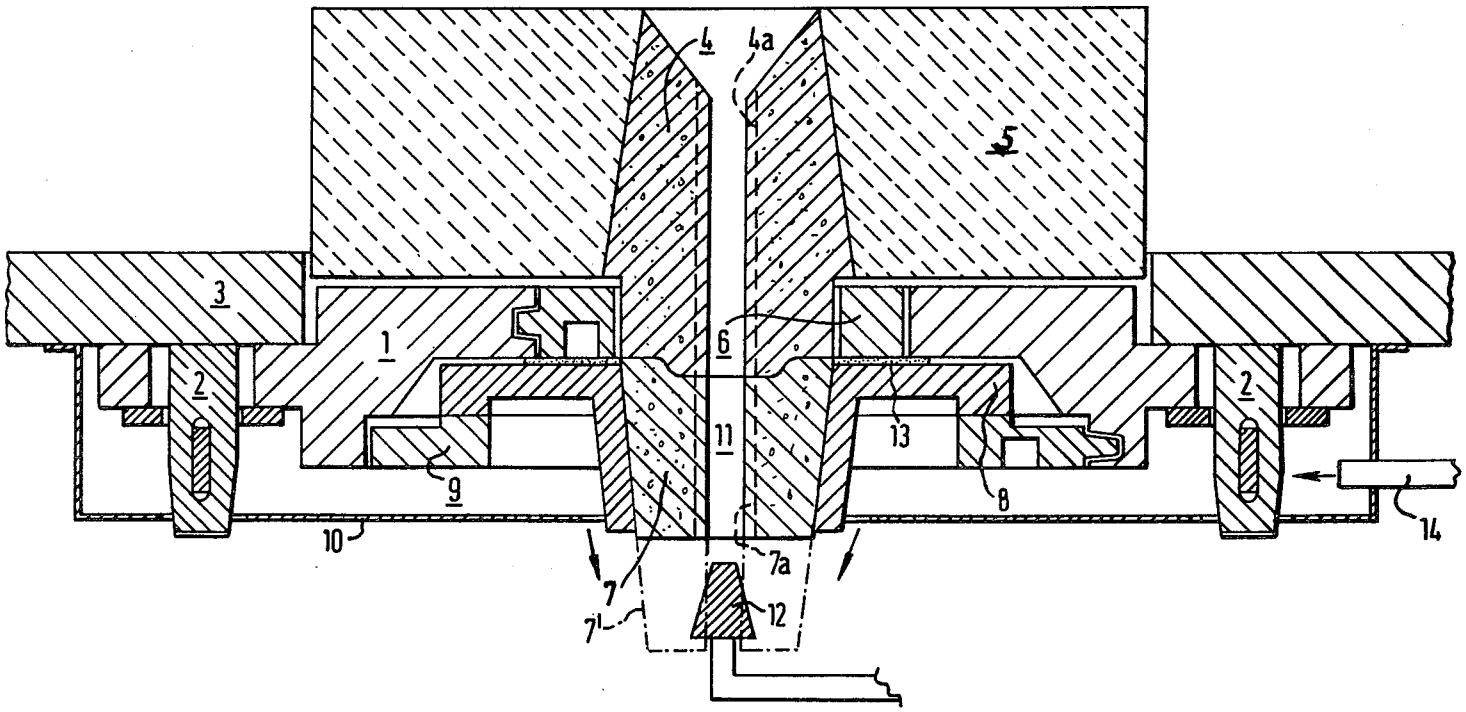
14
2
5
8
13
4a
6
11
7a
12
4
7
7'
9
1
10
3
2

APPARATUS FOR POURING MOLTEN STEEL

BACKGROUND OF THE INVENTION

1. Field of the Invention

The present invention relates to molten steel pouring methods and apparatus, in particular (but not solely) for supplying continuous casting moulds.

2. Description of the Prior Art

Pouring apparatus constituted by refractory nozzles fixed to the base plate of the liquid steel distribution tundishes provided in continuous casting plants is known. The utility of the nozzles, whose number corresponds to that of the casting lines, lies in the determination of the casting speed which is fixed by their diameter; this speed may nevertheless be slightly adjusted by modifying the steel level in the distribution tundishes.

It is known that the use of the continuous casting method contributes to decreasing the final cost price of iron and steel plants. For this purpose, the design of the majority of plants enables sequential casting in which the steel ladles are changed using a rotating turret and the distribution tundishes may possibly be changed "on line" without having to reset the machine according to the "dummy billet" method.

Sequential casting is a major objective and is carried out in order to achieve both a saving in costs and an increase in the rate of use of the plants. However, the service life of the nozzles of distribution tundishes is a limiting factor with respect to the required performance, and the failure of a nozzle during the sequence is detrimental to production outputs. In order to remedy this drawback "on line" replacement of the steel distribution tundishes is one solution; however, this operation is difficult in the case of plants having more than four casting lines and is accompanied by a deterioration of production outputs of the metal.

BRIEF SUMMARY OF THE INVENTION

The present invention aims to remedy this difficulty by providing a particularly advantageous solution consisting in positioning, below and against the base plate of distribution tundishes, a static liquid-steel pouring device. The problem can thus be solved by the replacement, during the sequence, of a defective detachable nozzle by a new detachable nozzle.

A detachable nozzle of this type has, in respect of existing nozzles, the advantage of a considerable increase in production and an increased efficiency, enabling the achievement of performances which are normally obtained in sequential casting, whilst ensuring that the cast product has an improved quality, as this nozzle may be changed at any time when its jet becomes prematurely defective.

The invention is based on the following observations:

the casting of the liquid steel on one line may be stopped before the substitution of a detachable nozzle by any independent system, for example the known method of blockage with a copper cone;

experiments have shown that, following this discontinuation of casting, the solidification of the steel in the channel above the detachable nozzle is sufficient to enable the disconnection and replacement of the detachable nozzle;

the down time on the line in question required by the two above operations is not longer than 15 minutes;

during this time, the casting of the liquid steel may be continued in a normal manner on the other lines;

the discontinued casting line may then be restarted in accordance with the "dummy billet" method.

The present invention accordingly provides a static liquid steel casting method and an apparatus for carrying out the method comprising a mounting chassis positioned below and against the base plate of a distribution tundish for liquid steel, by one or a plurality of connection points, and acting as a component for retaining a liquid steel collector nozzle, inserted in a refractory seating brick of the distribution tundish, and directly below this collector nozzle and in contact with this nozzle there is coaxially disposed a regulator nozzle which is detachable with respect to the collector nozzle and is maintained against the latter by suitable means.

At least one of the nozzles mentioned above may be of monobloc or one-piece design or may be of a compound design with an insert for example of stabilised zirconium oxide or electro-fused alumina.

Preferably, at least one of the nozzles has a frustoconical external surface. However, various shapes and conicities, and different designs of the junction surfaces of the nozzles, may my envisaged. The junction surfaces are preferably constituted by an assembly of plane and curved surface elements in such a way as to advantageously enable the centering of the lower nozzle and to obtain a high degree of leak-tightness between the nozzles during the passage of the molten steel.

The two nozzles preferably have respective frustoconical external surfaces which are orientated in opposite directions to one another. The use of a mounting having inverted conicity for the seating brick and the upper nozzle may be envisaged in the case of a cold distribution tundish enabling the upper nozzle to be mounted from the top. The lower nozzle may be of the immersed type.

The upper nozzle may be maintained against the seating brick by means of a rapid-locking fastening ring, the ring resting on the chassis. The lower nozzle may be releasably fixed against the upper nozzle by means of a rapid locking ring. The connection between the fastening ring for the upper nozzle and the lower nozzle may be provided by means of a mounting which is fixed with respect to the lower nozzle. This design enables rotation of the lower nozzle to be prevented during locking. Rapid locking means include, for example, bayonet, threaded, wedge, or guide block locking means. A refractory joint, for example of ceramic fibre, may be interposed between the holding ring of the upper nozzle and the mounting supporting the lower nozzle.

Suitable accessories may be provided, enabling the positioning and the fixation of a device for protecting the jet of liquid steel, in particular against oxidation caused by contact with the ambient air. The design of the mounting which provides the connection between the fastening ring for the upper nozzle and the lower nozzle depends on the type of protection device used. This device for protecting the steel jet may either project below the lower horizontal plane of the lower nozzle or not project below this plane. It may, for example, be a device which enables gas to be blasted into the vicinity of the liquid steel jet.

Also, it is preferable to provide a device which ensures protection against any liquid steel spray.

The exact composition of the materials used for the manufacture of the various components forming the apparatus depends on the mechanical and thermal stresses to which these components are subjected. Suitable materials may include steel, for example ordinary steel or alloy steel, or ordinary cast iron, steeled cast iron or specially designed cast iron. The method of manufacturing the various components may include casting components which are used in an untreated form, or completely machining components from rolled blanks, or casting components which are then finished completely or partially by machining. The refractory materials used are those currently used under normal casting conditions.

The apparatus and method described above can provide the following advantages:

an increase in the production outputs for continuous casting plants resulting from an increase in the average duration of the sequences;

an increase in the service life of the nozzles; in existing devices, the elimination of the plugs of steel and oxide forming in the vicinity of the outlet orifice is carried out by the action of an oxygen lance; the invention enables these plugs and oxides to be eliminated mechanically, as a result of the fact that the lower nozzle projects below the distributor; as a result of this mechanical action, the refractory of the lower nozzle deteriorates less rapidly, and the correct steel jet is maintained for a longer period;

simpler unblocking than in the case of the closure devices of slide devices taking into account that the channel length is less;

a component enabling the blasting of gas may be positioned about the lower nozzle without projecting below its lower horizontal plane, in order to provide improved protection of the liquid steel jet against oxidation in contact with the ambient air;

an improved finished product quality is provided;

in comparison with a "mini-slide" which is of a similar general design to a steel ladle slide, the operating costs of the present apparatus are considerably lower, in particular as a result of the absence of special machined refractory plates and its mechanical simplicity.

BRIEF DESCRIPTION OF THE DRAWING

The invention will be described further, by way of example, with reference to the accompanying drawing, in which the sole FIGURE, shows a longitudinal median section through part of an apparatus for pouring molten steel.

DETAILED DESCRIPTION

A mounting chassis 1 is fixed by fastening pivots 2 below and against the base plate of a molten steel distribution tundish 3. The chassis 1 covers an aperture in the base plate and acts as a holding element for a collector nozzle 4 which has a frusto-conical external surface, inserted in a refractory seating brick 5 (forming part of the refractory lining of the tundish 3) and held against the latter by a rapid-locking (bayonet-type) fastening ring 6. The nozzle 4 may be of one-piece construction as shown, or may have an insert 4*a* as indicated in broken line.

Directly below the nozzle 4 and in contact with it, a regulator nozzle 7 is coaxially positioned and has an external frusto-conical surface tapering in the opposite direction to that of the collector nozzle 4. The nozzle 7 may be of one-piece construction as shown, or may have an insert 7*a* as indicated in broken line. The nozzle 7 may also be extended to function as an immersion nozzle, as indicated in chain-dotted line at 7′.

The junction surfaces of the two nozzles 4,7 are designed as shown in the drawing, to prevent the infiltration of steel between these nozzles and to facilitate coaxial positioning. A connection between the ring 6 and the nozzle 7 is provided by a mounting 8 which is fixed with respect to the regulator nozzle. A refractory spacer 13 of ceramic fibre is interposed between the mounting 8 and the ring 6. The regulator nozzle 7 is detachable from the collector nozzle 4, being fixed to the latter by a rapid-locking (bayonet-type) ring 9.

A detachable protection sheet 10 completes the casting device and protects the chassis 1, the mounting 8, and the fastening ring 9 from being splashed by molten steel during pouring. Inert gas supplied to the space defined by the sheet 10 by a pipe 14 escapes downwards around the nozzle 7 and protects the steel jet.

The replacement of the detachable regulator nozzle 7, during a steel casting sequence, may be carried out using a closure element of a suitable shape and type, for example a copper cone 12, whose role is described below. When a regulator nozzle 7 which has become defective must be replaced, the following method is used:

(a) A closure piece as described above, for example a copper cone 12, is applied to the lower orifice of the regulator nozzle 7 in order to block the orifice completely. Consequently, the steel jet is stopped and the steel in the channel 11 at this time gradually solidifies upwardly, approximately up to the upper orifice of the collector nozzle 4, to a sufficient extent to prevent casting of the liquid steel contained in the distribution tundish 3.

(b) After several minutes, the portion of solidified steel contained in the portion of the duct 11 located within the regulator nozzle 7 is burnt off by means of suitable equipment, for example an oxygen lance or a burner.

(c) The regulator nozzle 7 may then be removed in the following way: the fastening ring 9 is removed and the mounting 8 removed, together with the regulator nozzle 7. After checking and cleaning of the junction surface of the collector nozzle 4, a new regulator nozzle 7 is positioned with the mounting 8 and is fastened by means of the fastening ring 9.

(d) When the new regulator nozzle 7 is positioned with its fastening elements, a burner, an oxygen lance, or any other suitable means is used to burn off the solidified steel contained in the portion of the duct 11 located within the collector nozzle 4, which enables the liquid steel to recommence flowing in a jet, and casting is continued on the line in question according to the "dummy billet" method.

I claim:

1. Apparatus for pouring molten steel, comprising a molten steel container having a base plate with an aperture and a nozzle seating brick in the aperture, a mounting chassis removably fixed to the underside of the base plate and extending across the aperture, an upper nozzle having an orifice therethrough mounted on the chassis and inserted in the nozzle-seating brick, a removable lower nozzle having an orifice therethrough coaxial with said orifice in said upper nozzle and in contact with the upper nozzle, releasable means engageable with said chassis for maintaining contact between the nozzles, and means for applying a closure member to said orifice of said lower nozzle.

2. Apparatus as claimed in claim 1, in which at least one of the nozzles is a one-piece nozzle.

3. Apparatus as claimed in claim 1, in which at least one of the nozzles is of a compound design with an insert.

4. Apparatus as claimed in claim 3, in which the insert is of stabilised zirconium oxide.

5. Apparatus as claimed in claim 1, in which at least one of the nozzles has a frusto-conical external surface.

6. Apparatus as claimed in claim 5, in which both nozzles have a frusto-conical external surface.

7. Apparatus as claimed in claim 6, in which the frusto-conical external surfaces taper in opposite directions.

8. Apparatus as claimed in claim 1, in which the lower nozzle is of the immersed type.

9. Apparatus as claimed in claim 1, in which the upper nozzle is maintained against the nozzle-seating brick by means of a rapid-locking fastening ring releasably engageable with and supported by the chassis.

10. Apparatus as claimed in claim 1, in which said releasable means comprises a rapid-locking ring releasably engageable with and supported by the chassis to urge the lower nozzle into contact with the upper nozzle.

11. Apparatus as claimed in claim 10, in which said releasable means further comprises a mounting member engaging said lower nozzle and engaged by said rapid-locking ring.

12. Apparatus as claimed in claim 11, further comprising a dish-shaped cover member removably attached at its periphery to the underside of said base plate to overly in spaced relationship said chassis, mounting member and releasable locking ring for protecting them from being splashed by molten steel during pouring, an aperture in said cover member surrounding said lower nozzle and means to supply inert gas to the space within said cover member so that said gas passes through said aperture to protect a jet of molten steel issuing from the lower nozzle.

13. Apparatus as claimed in claim 1, including a fastening ring supported by the chassis and maintaining the upper nozzle against the nozzle-seating brick, a mounting supporting the lower nozzle, and a refractory spacer between the ring and the mounting.

14. Apparatus as claimed in claim 1, further comprising a device for protecting the chassis and the releasable means from molten steel impinging from below.

15. A method of replacing a nozzle in apparatus for pouring molten steel comprising a molten steel container having a base plate with an aperture and a nozzle-seating brick in the aperture, a mounting chassis fixed to the underside of the base plate and extending across the aperture, an upper nozzle mounted on the chassis and inserted in the nozzle-seating brick, a removable lower nozzle which is coaxial with and in contact with the upper nozzle, and releasable means for maintaining contact between the nozzles, the method comprising the sequential steps of;

(a) applying a closure member to the orifice of the lower nozzle in order to block the orifice completely for a sufficient time to allow the steel within the nozzles to solidify;

(b) burning off the solidified steel located within the lower nozzle;

(c) releasing the said releasable means and removing the lower nozzle;

(d) positioning a new lower nozzle coaxially with and in contact with the upper nozzle and fastening the nozzles together by the said releasable means; and (e) burning off the solidified steel within the upper nozzle.

* * * * *